US009302275B2

(12) United States Patent
Verweij

(10) Patent No.: US 9,302,275 B2
(45) Date of Patent: Apr. 5, 2016

(54) CENTRIFUGE WITH SLIDING CARRIAGES, AND METHOD FOR OPERATING A CENTRIFUGE

(71) Applicant: Willem Marius Verweij, Schiedam (NL)

(72) Inventor: Willem Marius Verweij, Schiedam (NL)

( * ) Notice: Subject to any disclaimer, the term of this patent is extended or adjusted under 35 U.S.C. 154(b) by 0 days.

(21) Appl. No.: 14/403,869

(22) PCT Filed: May 21, 2013

(86) PCT No.: PCT/NL2013/050369
§ 371 (c)(1),
(2) Date: Nov. 25, 2014

(87) PCT Pub. No.: WO2013/176541
PCT Pub. Date: Nov. 28, 2013

(65) Prior Publication Data

US 2015/0141232 A1 May 21, 2015

(30) Foreign Application Priority Data

May 25, 2012 (NL) ..... 2008886

(51) Int. Cl.

| | |
|---|---|
| ***B04B 5/04*** | (2006.01) |
| ***B04B 9/10*** | (2006.01) |
| ***B04B 5/10*** | (2006.01) |
| ***B04B 9/00*** | (2006.01) |

(52) U.S. Cl.
CPC ..... *B04B 9/10* (2013.01); *B04B 5/0414* (2013.01); *B04B 5/0421* (2013.01); *B04B 5/10* (2013.01); *B04B 9/00* (2013.01)

(58) Field of Classification Search
CPC ..... B04B 9/10; B04B 5/0414; B04B 5/10; B04B 9/00; B04B 5/0421
USPC ..... 494/16–21, 34
See application file for complete search history.

(56) References Cited

U.S. PATENT DOCUMENTS

| | | | | |
|---|---|---|---|---|
| 3,635,394 | A * | 1/1972 | Natelson | 494/7 |
| 6,461,287 | B1 * | 10/2002 | Glater | 494/16 |
| 7,112,303 | B2 * | 9/2006 | Itoh | 422/72 |

(Continued)

FOREIGN PATENT DOCUMENTS

| | | |
|---|---|---|
| DE | 888 020 C | 8/1953 |
| DE | 16 73 311 A1 | 4/1970 |

OTHER PUBLICATIONS

International Search Report dated Aug. 7, 2013 in corresponding PCT application.

*Primary Examiner* — Charles Cooley
(74) *Attorney, Agent, or Firm* — Young & Thompson

(57) ABSTRACT

A centrifuge for high-speed centrifuging, includes: a shaft, mounted for continuous rotation about its axis, the shaft having a working section having a loading end and an unloading end; an acceleration member mounted adjacent to the loading end for rotation with respect to the shaft and; a deceleration member mounted adjacent to the unloading end for rotation with respect to the shaft; auxiliary drive arrangement for accelerating the acceleration member and the deceleration member to the shaft speed; carriages for supporting specimens for centrifugation. The carriages are slideably mounted for traversing from the acceleration member to the working section and from the working section to the deceleration member. A carriage may be accelerated on the acceleration member and then transferred to the working section for a period sufficient to perform centrifuging and then transferred from the working section to the deceleration member.

12 Claims, 5 Drawing Sheets

(56) References Cited

U.S. PATENT DOCUMENTS

| | | | | |
|---|---|---|---|---|
| 7,115,090 | B2 * | 10/2006 | Lagarde | 494/10 |
| 7,195,737 | B2 * | 3/2007 | Itoh | 422/72 |
| 7,803,101 | B2 * | 9/2010 | Porto | 494/11 |
| 8,795,144 | B2 * | 8/2014 | Pedrazzini | 494/20 |
| 2004/0089737 | A1 | 5/2004 | Itoh et al. | |
| 2015/0141232 | A1 * | 5/2015 | Verweij | B04B 5/10 494/16 |

* cited by examiner

CENTRIFUGE WITH SLIDING CARRIAGES, AND METHOD FOR OPERATING A CENTRIFUGE

FIELD OF THE INVENTION

The present invention relates to a centrifuge for high-speed centrifugation of, for example, test tubes, in particular test tubes containing blood samples.

BACKGROUND OF THE INVENTION

In most laboratories, centrifugation takes place in a batch process, whereby a centrifuge is loaded with sample tubes and run up to speed. After a requisite period of steady state spinning, operation is stopped whereby the centrifuge must be allowed to run out slowly. Excessive braking is detrimental to the sample, and may lead to remixing of the separated portions. Once stopped, the centrifuge may be unloaded and a new batch prepared. Such systems are not very versatile and do not allow urgent samples to be handled.

An example of such a centrifuge is given in U.S. Pat. No. 3,635,394. This publication shows a centrifuge, wherein the rotor must be decelerated or halted in order to load further samples or to unload centrifuged samples.

It would be desirable to provide a centrifuge that is versatile and can easily be adapted to handle samples in a continuous manner. Preferably, the centrifuge should be simple to manufacture and operate.

SUMMARY OF THE INVENTION

Hereto the centrifuge according to the invention is provided with:

a shaft, mounted for continuous rotation about its axis, the shaft having a working section having a loading end and an unloading end;

an acceleration member mounted adjacent to the loading end for rotation with respect to the shaft and;

a deceleration member mounted adjacent to the unloading end for rotation with respect to the shaft;

auxiliary drive arrangement for accelerating the acceleration member and the deceleration member to the shaft speed;

a plurality of carriages for supporting specimens for centrifugation;

wherein the carriages are slideably mounted for traversing from the acceleration member to the working section and from the working section to the deceleration member whereby a carriage may be accelerated on the acceleration member and then transferred to the working section for a period sufficient to perform centrifuging and then subsequently transferred from the working section to the deceleration member.

The afore-mentioned centrifuge allows continuous operation using a relatively simple and cost-effective construction: first the shaft and the working section are rotated at a constant speed suitable for centrifugation. Then a carriage, for example containing test tubes with blood samples, can be attached to the acceleration member. Subsequently the auxiliary drive arrangement is used for accelerating the acceleration member to match the rotational speed of the working section after which the acceleration member is coupled to the working section via the loading end thereof. The carriage is then transferred from the acceleration member to the working section for being centrifuged, after which the acceleration member is decoupled from the working section. In order to unload the carriage from the working section the auxiliary drive arrangement is used for accelerating the deceleration member to match the rotational speed of the working section. Then the centrifuged carriage is transferred from the working section to the deceleration member via its unloading end, after which the deceleration member is decoupled from the working section. The deceleration member with the centrifuged carriage is then decelerated so that the carriage can be taken off. This centrifuge has a relatively simple and therefore relatively cheap construction and allows continuous loading and unloading of carriages.

A further embodiment relates to a centrifuge, wherein the working section, the acceleration and deceleration members are respectively arranged, during use, in a consecutive manner along the length of the shaft. This makes the transferring of carriages from the acceleration member to the working section and further to the deceleration member relatively easy.

Another embodiment foresees a centrifuge, wherein the acceleration member and the deceleration member have a cylindrical shape and the shaft extends in longitudinal direction through these members. This enables the centrifuge construction to be even more compact.

Preferably, a centrifuge is provided, wherein the loading or unloading ends of the working section on the one hand or one of the acceleration or deceleration members on the other hand are provided with coupling means for coupling and decoupling these members to the working section. Thus the speed of the acceleration and deceleration members can be fixed with respect to the working section allowing smooth transfer of a carriage.

Another advantageous embodiment relates to a centrifuge, wherein the coupling means comprise a pin arranged on the loading end of the working section and a recess arranged on the acceleration member to be coupled thereto or vice versa, or a pin arranged on the unloading end of the working section and a recess arranged on the deceleration member, respectively, or vice versa, wherein the pin and recess are arranged for engaging each other. Such a pin-and-recess construction allows for a fail-safe coupling mechanism.

A yet further embodiment relates to a centrifuge, wherein transfer means are provided for transferring a carriage attached to the acceleration member to the working section or for transferring a carriage attached to the working section to the deceleration member during use. These transfer means allow for timely and smooth transfer of carriages.

It would furthermore be advantageous if the working section, the acceleration member or the deceleration member on the one hand, and the carriages on the other hand, are provided with mutually engaging splines and grooves. Such a spline-and-groove design furthermore facilitates easy transfer of samples in shaft direction.

The rotational speed of the shaft is at least 3000 RPM during use, such that sufficient separation of test tube components is achieved.

The invention also relates to a carriage for use with aforementioned centrifuge.

An advantageous embodiment relates to a carriage, having a C-shaped engaging portion for slideably engaging the carriage to the working section, the acceleration member or the deceleration member. The C-shaped carriage can easily be slid unto and transferred along the working section and acceleration and deceleration members.

Additionally the invention relates to an assembly of a centrifuge and one or more carriages, the one or more carriages being slideably connected to traverse along the working section and the acceleration and deceleration members.

A further embodiment foresees an assembly, wherein the carriage has a projecting part in the form of a screw for engagement with a groove of the working section, the acceleration member or the deceleration member. The screw-and-groove connection allows for a reliable connection necessary at high centrifugation speeds.

Preferably, the centrifuge is provided with appropriate housing and guard members to shield the working parts during use. These may be provided with appropriate interlock mechanisms for loading and unloading purposes. The housing may comprise a cabinet preventing access to the moving components and access doors for loading and unloading the carriages.

Another aspect of the invention relates to a method for operating a centrifuge according to one of the preceding claims, comprising the following steps:

rotating the shaft and the working section at a constant speed suitable for centrifugation, attaching a carriage to the acceleration member, using the auxiliary drive arrangement for accelerating the acceleration member to match the rotational speed of the working section, coupling the acceleration member to the working section, transferring the carriage from the acceleration member to the loading end of the working section for being centrifuged, decoupling the acceleration member from the working section, using the auxiliary drive arrangement for accelerating the deceleration member to match the rotational speed of the working section, after a period sufficient to perform centrifuging, transferring a centrifuged carriage from the unloading end of the working section to the deceleration member, decoupling the deceleration member from the working section, and decelerating the deceleration member with the centrifuged carriage.

Please note that the centrifuge can be adapted and scaled to the desired production rate. It is conceivable that a carriage with only one test-tube is used, but otherwise carriages with a hundred test-tubes can also be used with the centrifuge according to the invention. In practice, the time required for slowing the carriages or manipulating them will be a limiting factor as to the amount of carriages that can be simultaneously centrifuged on the working section without exceeding the optimal centrifugation time.

BRIEF DESCRIPTION OF THE DRAWINGS

An embodiment of a continuously operable centrifuge for high-speed centrifugation according to the invention will by way of non-limiting example be described in detail with reference to the accompanying drawings. In the drawings.

DETAILED DESCRIPTION OF THE INVENTION

Figure 1:
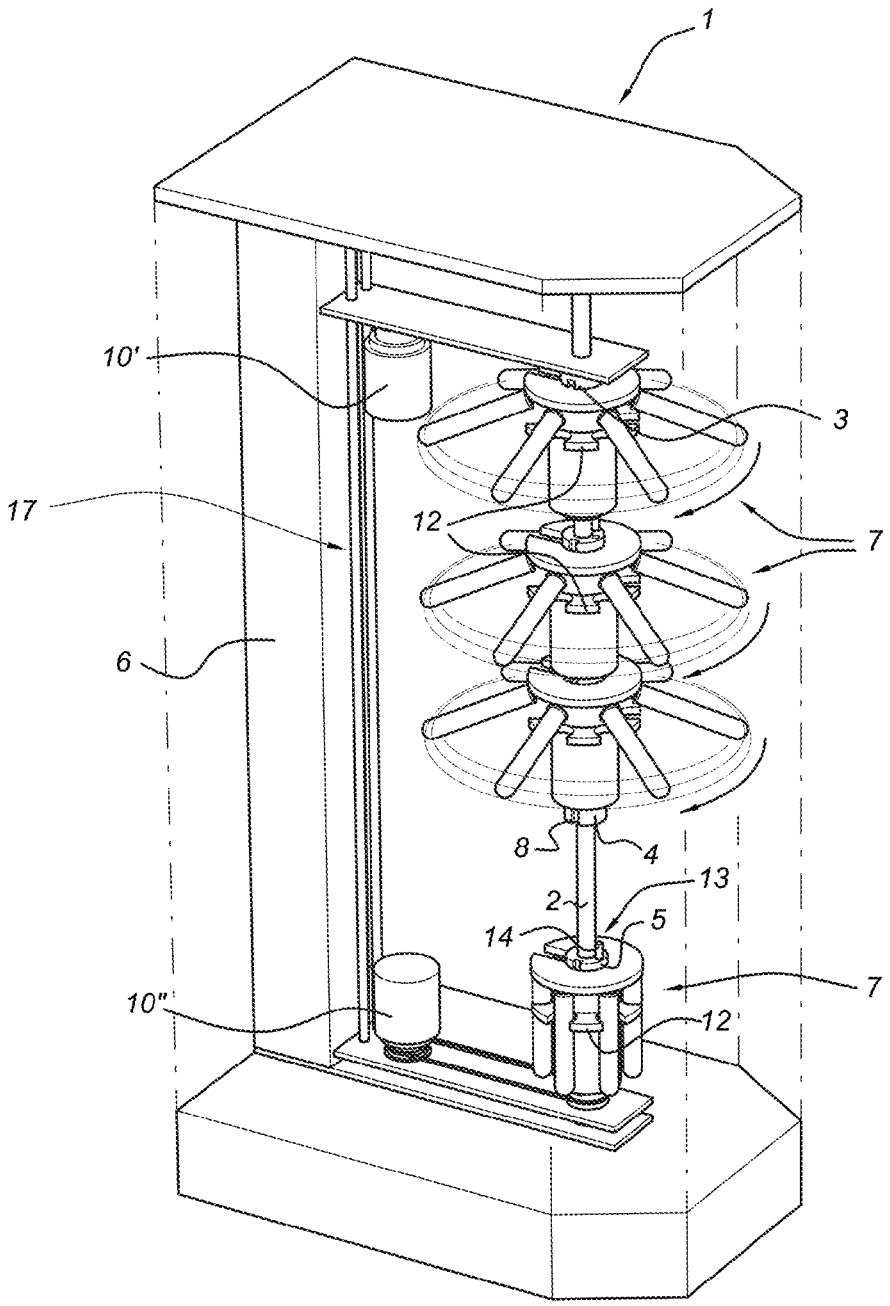
FIG. 1 shows a centrifuge according to the invention in perspective view.

FIG. 1 shows a centrifuge 1 according to the invention in perspective view. The centrifuge 1 as shown in FIG. 1 comprises a shaft 2 rotatably mounted in a frame 6. The frame 6 is preferably arranged in a cabinet (schematically shown as dotted lines), with a door for loading and unloading, to prevent the formation of aerosols. The cabinet also serves to protect the rotating parts and allows for additional cooling of the centrifuge. During use the shaft 2 is preferably, but not necessarily, vertical as to allow smooth rotation of carriages 7. The shaft 2 can be hollow as to allow the accommodation of a co-rotating mechanism for fixation or manipulation of a carrier from the inside out. A central rotatable cylinder 4 is arranged on the shaft 2. The central rotatable cylinder 4 is rigidly connected to the shaft 2 such that when the shaft 2 is rotated the cylinder 4 also rotates at the same rotational speed. The shaft 2 is connected to a shaft drive motor (not shown). Above the central cylinder 4 an upper rotatable cylinder 3 is arranged. This cylinder 3 is loosely mounted on the shaft 2 and is connected to an auxiliary drive motor 10' positioned near the upper cylinder 3. Below the central cylinder 4 a lower rotatable cylinder 5 is loosely mounted on the shaft 2. This cylinder 4 is also connected to an auxiliary drive motor 10". The three cylinders 3, 4, 5 are provided with a longitudinal grooves 8 or splines 15. When the three cylinders 3, 4, 5 are coupled to each other, via coupling means 13, the individual grooves form a single continuous groove 8. The grooves allow a screw 15 (that serves as the spline) provided in a screw thread, or a notch, of a clamping member 7' of a carriage to be received therein, such that the carriage can be connected rigidly to the cylinder 3, 4, 5. The continuous groove 8 allows carriages to be transferred vertically from one cylinder to another. Multiple grooves can be provided along the circumference of a cylinder 3, 4, 5. Preferably, the clamping member 7' is C-shaped such that it can be easily attached to, and traversed along, a cylinder 3, 4, 5. The central cylinder 4 as shown in FIG. 1 has two C-shaped clamping members attached to it.

The centrifuge can be operated as follows: first the shaft drive means for rotating the shaft 2 and the central rotatable cylinder 4 is activated to rotate the shaft 2 at a constant speed suitable for centrifugation, e.g. 3000 RPM. This speed, however, depends on the diameter of the rotor. Typically, the speed is adapted to generate a centrifugal force of 1000-1500 g during 10-15 min. Otherwise, it is advisable to consult the USA Clinical and Laboratory Standards Institute guidelines CLSI H18-A4.

The period for centrifugation can for example be 5 min, although the skilled person will be aware that this period will be chosen according to the sample and protocol required. Then a carriage, for example containing test tubes with blood samples, can be attached to the upper rotatable cylinder 3, which is stationary then. This will take place through the loading door in the cabinet. The auxiliary drive motor 10' is subsequently used for accelerating the upper rotatable cylinder 3 to match the rotational speed of the central cylinder 4 after which the upper cylinder 3 is coupled to the central cylinder 4 by actuation of an actuator that allows movement of the cylinder 3 in shaft direction, such as the construction shown in FIG. 1, wherein the upper end of the upper cylinder 3 is rotatably mounted on a mounting plate that is moveable along guide rails running parallel to the shaft 2. The carriage is then transferred via the groove 8 from the upper cylinder 3 to the central cylinder 4 for being centrifuged, after which the upper cylinder 3 is decoupled from the central cylinder 4. The coupling is preferably done via a pin 14 arranged on one cylinder and a corresponding recess 16 arranged on the other, adjacent cylinder. However, other coupling means 13 are also conceivable. In order to unload the carriage from the central cylinder 4 the auxiliary drive means are used for accelerating the lower rotatable cylinder 5 to match the rotational speed of the central cylinder 4. Then the centrifuged carriage is transferred from the central cylinder 4 to the lower cylinder 5 via the groove 8, after which the lower cylinder is decoupled from the central cylinder 4. The lower cylinder 5 with the centrifuged carriage is then decelerated so that the carriage can be taken off. The time for decelerating the carriage is preferably more than 1 min to prevent remixing of the contents of e.g. the test tubes. However, note that the deceleration speed that is possible with test tubes containing a blood sample also depends on the separation gel used in the test tube. The centrifuge 1 is to be provided with means for tuning the deceleration speed with respect to the sample contained in the test tube.

Figure 2:
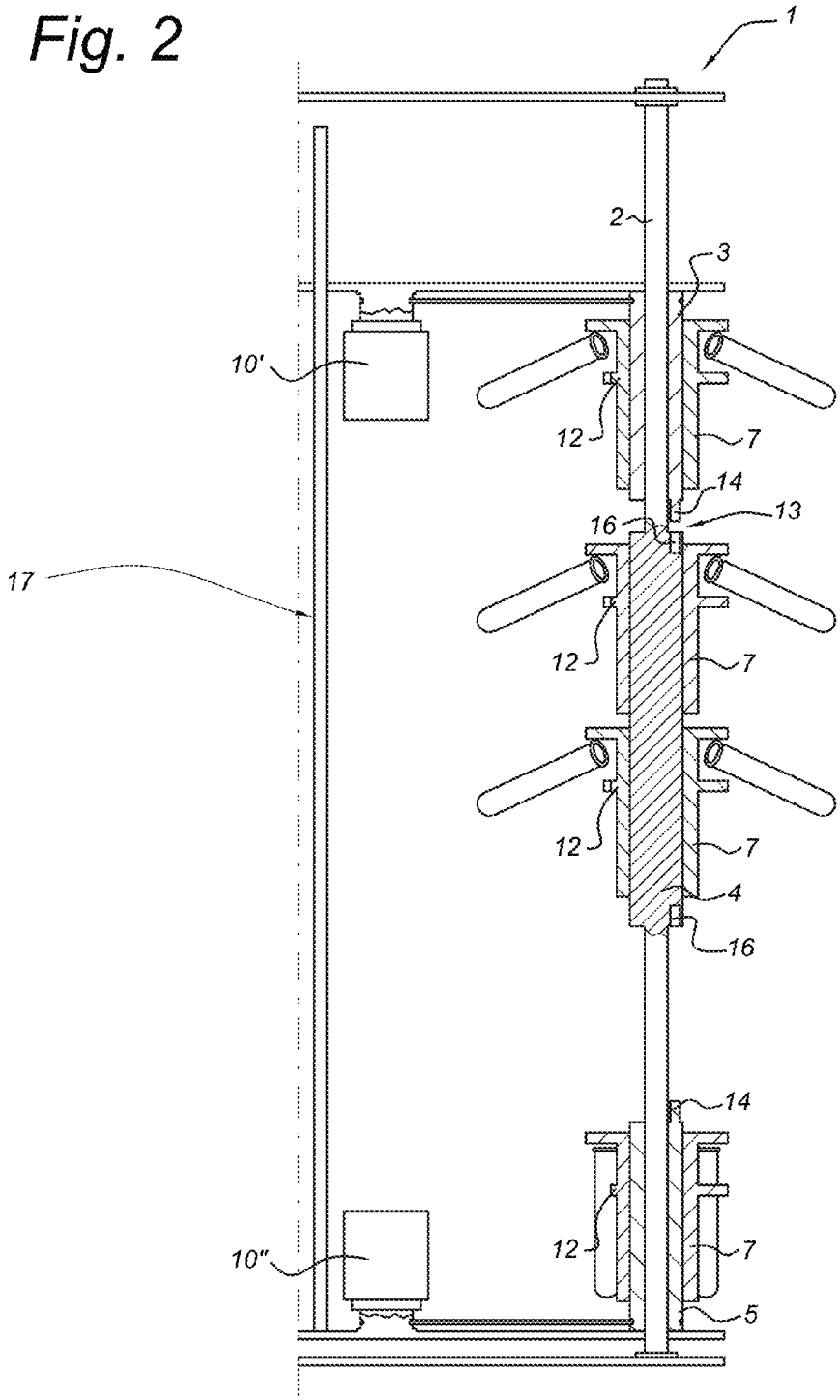
FIG. 2 shows the centrifuge of FIG. 1 in cross-section.

FIG. 2 shows the centrifuge 1 of FIG. 1 in cross-section.

Figure 3:
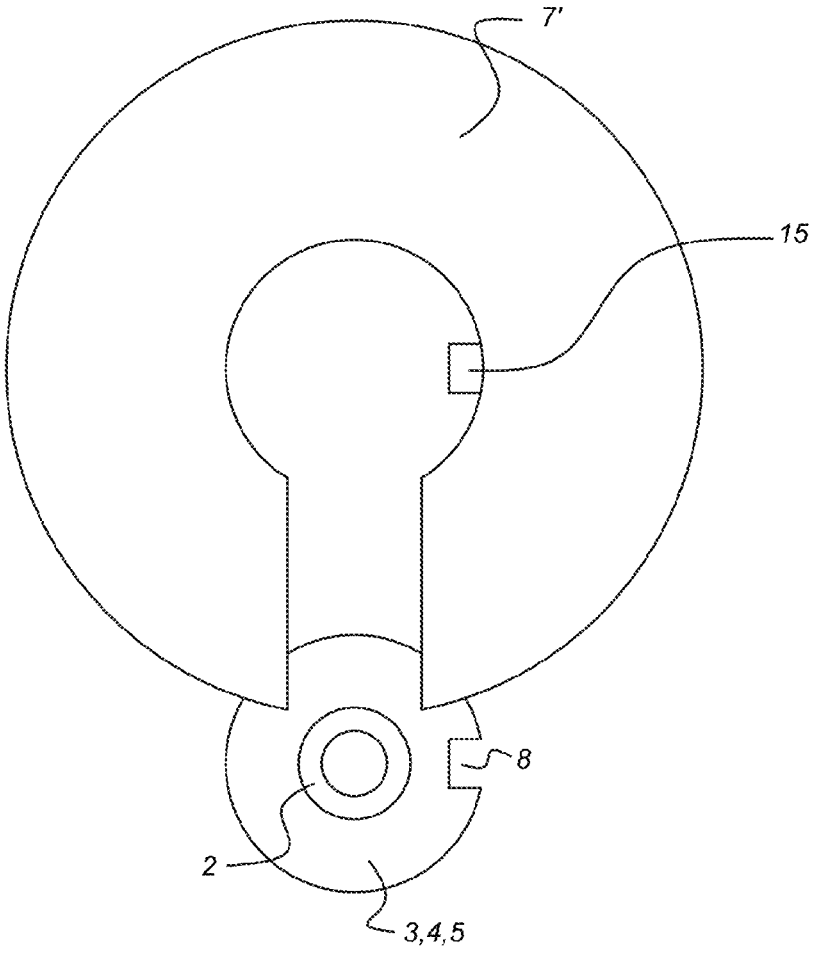
FIG. 3 shows an embodiment of a C-shaped clamping member.

FIG. 3 shows an embodiment of a C-shaped clamping member 7', having a notch, that is able to engage the groove 8 in one of the cylinder 3, 4, 5. The open end of the C-shape has such a width that the clamping member can be conveniently slid over the shaft 2.

Figure 4:
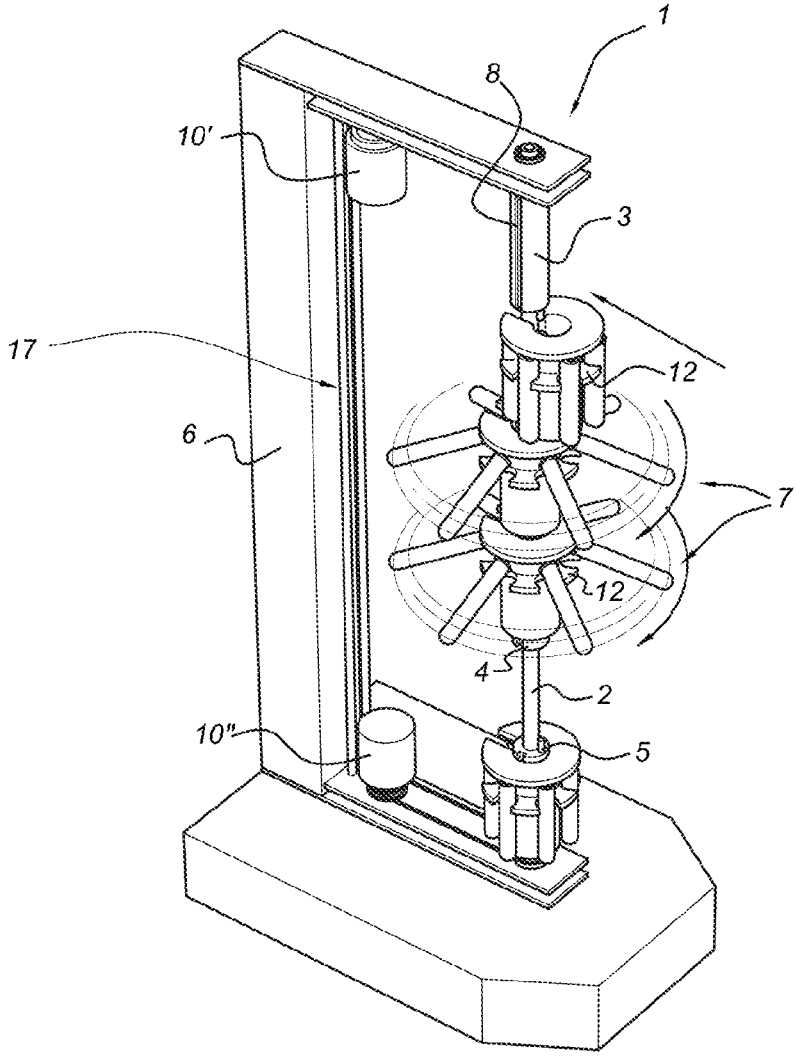
FIG. 4 schematically shows the addition of a carriage to the centrifuge while it is operational.

FIG. 4 schematically shows the addition of a carriage to the centrifuge while it is operational.

Figure 5:
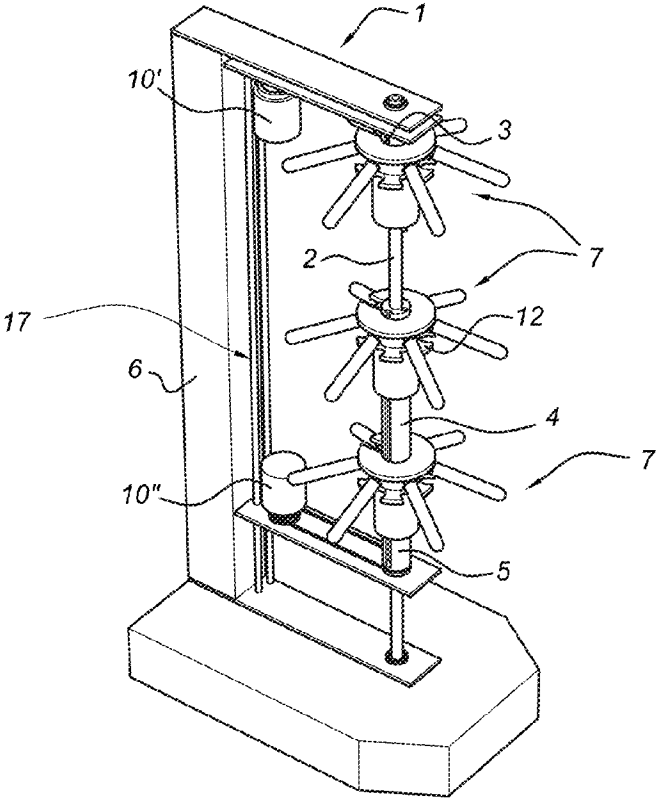
FIG. 5 shows the lower cylinder being coupled to the central cylinder of the centrifuge as to unload a centrifuged sample from the central cylinder.

FIG. 5 shows the lower cylinder being coupled to the central cylinder of the centrifuge as to unload a centrifuged sample from the central cylinder.

Figure 6:
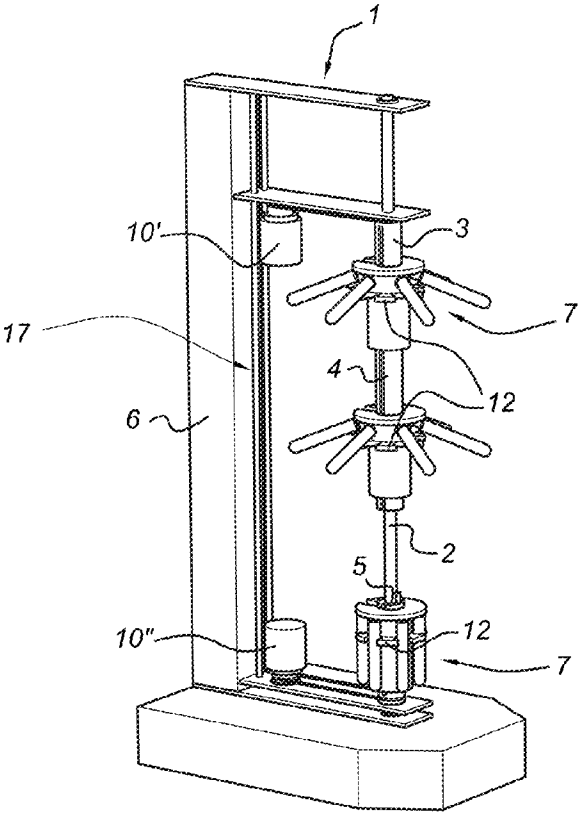
FIG. 6 shows the upper cylinder being coupled to the central cylinder as to load another sample on the central cylinder.

FIG. 6 shows the upper cylinder being coupled to the central cylinder as to load another sample on the central cylinder.

Thus, the invention has been described by reference to the embodiment discussed above. It will be recognized that this embodiment is susceptible to various modifications and alternative forms well known to those of skill in the art without departing from the spirit and scope of the invention. Accordingly, although a specific embodiment has been described, this is an example only and is not limiting upon the scope of the invention. Generally, the principles described above can also be used in other applications, such as with a merry-go-round, a carousel or the like.

LIST OF REFERENCE NUMERALS

1. Centrifuge
2. Shaft
3. Upper rotatable cylinder
4. Central rotatable cylinder
5. Lower rotatable cylinder
6. Frame
7'. Clamping member
7. Carriage
8. Groove
9. Shaft drive motor
10', 10". Auxiliary drive motor
11. Brake
12. Carriage
13. Coupling means
14. Pin
15. Screw/spline
16. Recess
17. Guide rails

The invention claimed is:

1. Centrifuge (1) for high-speed centrifuging, comprising:
a shaft (2) driven by a shaft drive motor, mounted for continuous rotation about its axis, the shaft (2) having a working section (4) having a loading end and an unloading end;
an acceleration member (3) mounted adjacent to the loading end for rotation with respect to the shaft (2) and;
a deceleration member (5) mounted adjacent to the unloading end for rotation with respect to the shaft (2);
an auxiliary drive arrangement (10', 10") comprising a first auxiliary drive motor (10') for accelerating the acceleration member (3) to the shaft speed, and a second auxiliary drive motor (10") for accelerating the deceleration member (5) to the shaft speed;
a plurality of carriages (7) for supporting specimens for centrifugation;
wherein the plural carriages (7) are slideably mounted for traversing from the acceleration member (3) to the working section (4) and from the working section to the deceleration member (5) whereby one carriage (7) of the plurality of carriages may be accelerated on the acceleration member (3) and then transferred to the working section (4) for a period sufficient to perform centrifuging and then subsequently transferred from the working section (4) to the deceleration member (5).

2. Centrifuge (1) according to claim 1, wherein the working section (4), the acceleration (3) and deceleration (5) members are respectively arranged, during use, in a consecutive manner along the length of the shaft (2).

3. Centrifuge (1) according to claim 1, wherein the acceleration member (3) and the deceleration member (5) have a cylindrical shape and the shaft (2) extends in longitudinal direction through these members (3, 5).

4. Centrifuge (1) according to claim 1, wherein the loading or unloading ends of the working section (4) or one of the acceleration (3) or deceleration members (5) are provided with coupling means for coupling and decoupling these members (3, 5) to the working section (4).

5. Centrifuge (1) according to claim 4, wherein the coupling means comprise a pin arranged on the loading end of the working section (4) and a recess arranged on the acceleration member (3) to be coupled thereto or vice versa, or a pin arranged on the unloading end of the working section (4) and a recess arranged on the deceleration member (5), respectively, or vice versa, wherein the pin and recess are arranged for engaging each other.

6. Centrifuge (1) according to claim 1, wherein transfer means (8) are provided for transferring the one carriage (7) of the plurality of carriages attached to the acceleration member (3) to the working section (4) or for transferring the one carriage (7) of the plurality of carriages attached to the working section (4) to the deceleration member (5) during use.

7. Centrifuge (1) according to claim 1, wherein the working section (4), the acceleration member (3) or the deceleration member (5), and the plural carriages (7), are provided with mutually engaging splines (15) and grooves (8).

8. Centrifuge (1) according to claim 1, wherein the rotational speed of the shaft (2) is at least 3000 RPM during use.

9. Centrifuge (1) according to claim 1, wherein the plural carriages (7) each have a projecting part in the form of a screw (15) for engagement with a groove (8) of the working section (4), the acceleration member (3) or the deceleration member (5).

10. A high-speed centrifuge (1), comprising:
a carriage (7);
a shaft (2), mounted for continuous rotation about its axis, the shaft (2) having a working section (4) having a loading end and an unloading end;
an acceleration member (3) mounted adjacent to the loading end for rotation with respect to the shaft (2) and;
a deceleration member (5) mounted adjacent to the unloading end for rotation with respect to the shaft (2), wherein the carriage (7) is slideably mountable for traversing from the acceleration member (3) to the working section (4) and from the working section to the deceleration member (5).

11. Centrifuge (1) according to claim 10, wherein, the carriage (7) has a C-shaped engaging portion for slideably engaging the carriage (7) to the working section (4), the acceleration member (3) or the deceleration member (5), and the carriage (7) has a C-shaped form as seen from above during use.

12. Method for operating a high-speed centrifuge (1) comprising a shaft (2), mounted for continuous rotation about its axis, the shaft (2) having a working section (4) having a loading end and an unloading end; an acceleration member (3) mounted adjacent to the loading end for rotation with respect to the shaft (2); a deceleration member (5) mounted adjacent to the unloading end for rotation with respect to the shaft (2); a first auxiliary drive motor (10') for accelerating the acceleration member (3) to the shaft speed; and a second auxiliary drive motor (10") for accelerating the deceleration member (5) to the shaft speed, the method, comprising the following steps:

rotating the shaft (2) and the working section (4) at a constant speed suitable for centrifugation, attaching a carriage (7) to the acceleration member (3), using the first auxiliary drive arrangement (10') for accelerating the acceleration member (3) to match the rotational speed of the working section (4), coupling the acceleration member (3) to the working section (4), transferring the carriage (7) from the acceleration member (3) to the loading end of the working section (4) for being centrifuged, decoupling the acceleration member (3) from the working section (4), using the second auxiliary drive arrangement (10") for accelerating the deceleration member (5) to match the rotational speed of the working section (4), after a period sufficient to perform centrifuging, transferring a centrifuged carriage (7) from the unloading end of the working section (4) to the deceleration member (5), decoupling the deceleration member (5) from the working section (4), and decelerating the deceleration member (5) with the centrifuged carriage (7).

* * * * *